US011794949B1

(12) United States Patent
Garrigan

(10) Patent No.: US 11,794,949 B1
(45) Date of Patent: Oct. 24, 2023

(54) SYSTEM AND METHOD FOR REPURPOSING A TENNIS BALL CANISTER

(71) Applicant: Patrick Garrigan, Los Angeles, CA (US)

(72) Inventor: Patrick Garrigan, Los Angeles, CA (US)

( * ) Notice: Subject to any disclaimer, the term of this patent is extended or adjusted under 35 U.S.C. 154(b) by 0 days.

(21) Appl. No.: 18/163,876

(22) Filed: Feb. 3, 2023

(51) Int. Cl.
*B65D 8/00* (2006.01)
*B65D 6/10* (2006.01)
*B65D 25/18* (2006.01)

(52) U.S. Cl.
CPC ..... *B65D 11/04* (2013.01); *B65D 11/16* (2013.01); *B65D 25/18* (2013.01)

(58) Field of Classification Search
CPC ..... B65D 45/32; B65D 45/00; B65D 50/00; B65D 2255/00; B65D 2215/00; B65D 2211/00; B65D 2590/04; B65D 2590/046; B65D 90/041; B65D 90/046; B65D 15/14; B65D 15/08; B65D 11/16; B65D 11/02; B65D 11/04; B65D 25/18
See application file for complete search history.

(56) References Cited

U.S. PATENT DOCUMENTS 1,337,491 A * 4/1920 Taylor ..... B65D 45/32 292/256.61
1,343,955 A * 6/1920 Baker ..... B65D 45/32 292/256.61
2,139,326 A * 12/1938 Brandt ..... B65D 43/0233 217/89
3,156,279 A * 11/1964 Grebowiec ..... B65D 11/16 215/44
4,299,100 A * 11/1981 Crisman ..... B65D 81/3883 220/592.17
4,466,553 A * 8/1984 Zenger ..... B65D 25/18 220/666
4,771,911 A * 9/1988 Morony ..... B65D 11/16 220/592.16
5,515,991 A * 5/1996 Heitland ..... A45D 34/00 220/8
5,556,494 A * 9/1996 Schutz ..... B29C 65/5085 156/304.6
7,669,725 B2 * 3/2010 Randolph ..... A61J 11/0065 220/23.91

(Continued)

*Primary Examiner* — Kareen K Thomas
(74) *Attorney, Agent, or Firm* — Metropolis IP Group, LLC; Eric Kang

(57) ABSTRACT

A system and method for repurposing tennis ball canisters, wherein said system comprises an insertable liner, further comprising a vessel, a lower collar flange, an upper collar flange, a plurality of notch(es) distributed about the upper collar flange, and a collar. Said system further comprises a retainer ring comprising a band portion, one or more tab(s), and a radially inward protruding ridge within said band. Said method comprises placing at least the liner into the bore of the canister barrel until the underside surface of the lower collar flange is in contact with the canister's lip, placing the retainer ring on the topside surface of the upper collar flange, orienting the retainer ring's angular position until the tab(s) are within the complementary notch(es) of the upper collar flange, and finally pressing the retainer ring downward until the retainer ring's radially inward protruding locking topology is snapped under the canister's lip.

13 Claims, 9 Drawing Sheets

(56) References Cited

U.S. PATENT DOCUMENTS

| | | | | |
|---|---|---|---|---|
| 7,959,866 | B2 * | 6/2011 | Crawford | B01L 3/5082 422/550 |
| 8,616,404 | B1 * | 12/2013 | Starck | B65D 81/022 220/592.2 |
| 2006/0081631 | A1 * | 4/2006 | Smith | B65D 45/32 220/62.22 |
| 2008/0190927 | A1 * | 8/2008 | Bougoulas | B65D 47/08 220/212 |
| 2014/0263338 | A1 * | 9/2014 | Stolzman | B65D 15/08 220/289 |

* cited by examiner

SYSTEM AND METHOD FOR REPURPOSING A TENNIS BALL CANISTER

FIELD OF THE DISCLOSURE

The field of the disclosure relates to recycling and more particularly to a device and method to repurpose a tennis ball canister into a safe beverage container.

BACKGROUND OF THE DISCLOSURE

In 2016, the U.S. generated 46.3 million tons of plastic trash, according to a 2020 study published in Science Advances [Law, Kara Lavender, et al., "The United States' contribution of plastic waste to land and ocean," Science Advances, 10/30/20, https://www.science.org/doi/10.1126/sciadv.abd0288]. Even before disposal, plastics have already adversely impacted the environment because they are generally made from fossil fuels, in an energy-intensive process that emits greenhouse gases and typically hazardous chemical byproducts. Compounding this issue is that just 8.7 percent of plastics that were discarded in the U.S. in 2018 were recycled, according to the Environmental Protection Agency. The rest are landfilled where they break down into elements that harm our water, air, and food, or incinerated in a greenhouse-gas emitting process, or are shipped abroad.

A major subset of the plastic disposal issue is from discarded water bottles, where there are more than 2 million tons in landfills across the U.S. Another source is disposed tennis ball canisters that are designed to preserve a tennis ball's bounce before they are first opened. Unlike many other sports balls such as footballs and basketballs, tennis balls have a relatively short service life and need to be replaced frequently. Consequently, with tennis being a popular sport, as many as 500 million tennis balls are made each year, which translates to many tennis ball canisters made and eventually disposed of. In order to properly recycle tennis ball canisters, and even provided that the plastic canister is recyclable, the metal lip lining the opening of the tennis ball canister needs to be cut out and separated from the rest of the plastic canister before recycling, which is an energy and investment-intensive proposition for just one sort of container.

Hence, that leaves producing plastic-free tennis ball packaging or repurposing plastic tennis ball canisters as potentially better, environmentally friendly end-of-life pathways. Regarding repurposing, the substantially cylindrical form of tennis ball canisters and the fact that most can be grasped by a human hand also makes it potentially viable for a beverage container. However, the inner surface of such canisters may contain at least trace amounts of harmful substances. Studies have linked chemicals found in plastics with ailments such as cancer or disruption to the endocrine, cardiovascular, fertility, and neurological systems. Currently, there are no known devices are methods to repurpose tennis ball canisters into safe beverage containers.

SUMMARY OF THE DISCLOSURE

The present invention solves an aspect of the plastic disposal and recycling problem with a novel system and method to repurpose tennis ball canisters ("canisters") that have not otherwise been addressed or suggested in the manner disclosed. The system comprises an insertable liner with a slightly smaller diameter or dimension than the inner diameter or dimension of the canister and a tabbed liner-to-canister retainer ring ("retainer ring"). While the liner itself is sufficient to be a standalone beverage container, the canister acts as an outer wall to a double-walled beverage container. The air gap between the canister and liner provides several potential benefits. The air gap can accommodate an insertable design wrap such as a printed photograph or pattern so one can both individualize and periodically change the appearance as seen through transparent versions of canisters. Secondly, the air gap serves as thermal insulation since it is generally known in the art that heat conduction through a gas is relatively slow and inefficient compared to solid media. Finally, insulation can be further augmented by having an insulating material fill that liner-to-canister gap.

One foundational, and several key aspects enable the functionality and utility of the present invention. The foundational aspect is, for the exemplary embodiment, the circular opening of the canister should have a ring-like lip with a small radially outward protrusion. This lip limits axial displacement of the liner's lower collar flange and hence the entire liner as well. The lip also is where the retainer ring's inner bottom surface's locking topology can engage. The retainer ring also has one or a plurality of tab(s) distributed about its circumference that each engages into a complementary notch along the circumference of the liner's upper collar flange, where the upper collar flange extends beyond the extent of the canister's walls. The combination of the above aspects allows the liner to be axially and rotationally fixed to the canister.

BRIEF DESCRIPTION OF THE DRAWINGS

The drawings are provided to facilitate understanding of the detailed description. It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE DISCLOSURE

Figure 1:
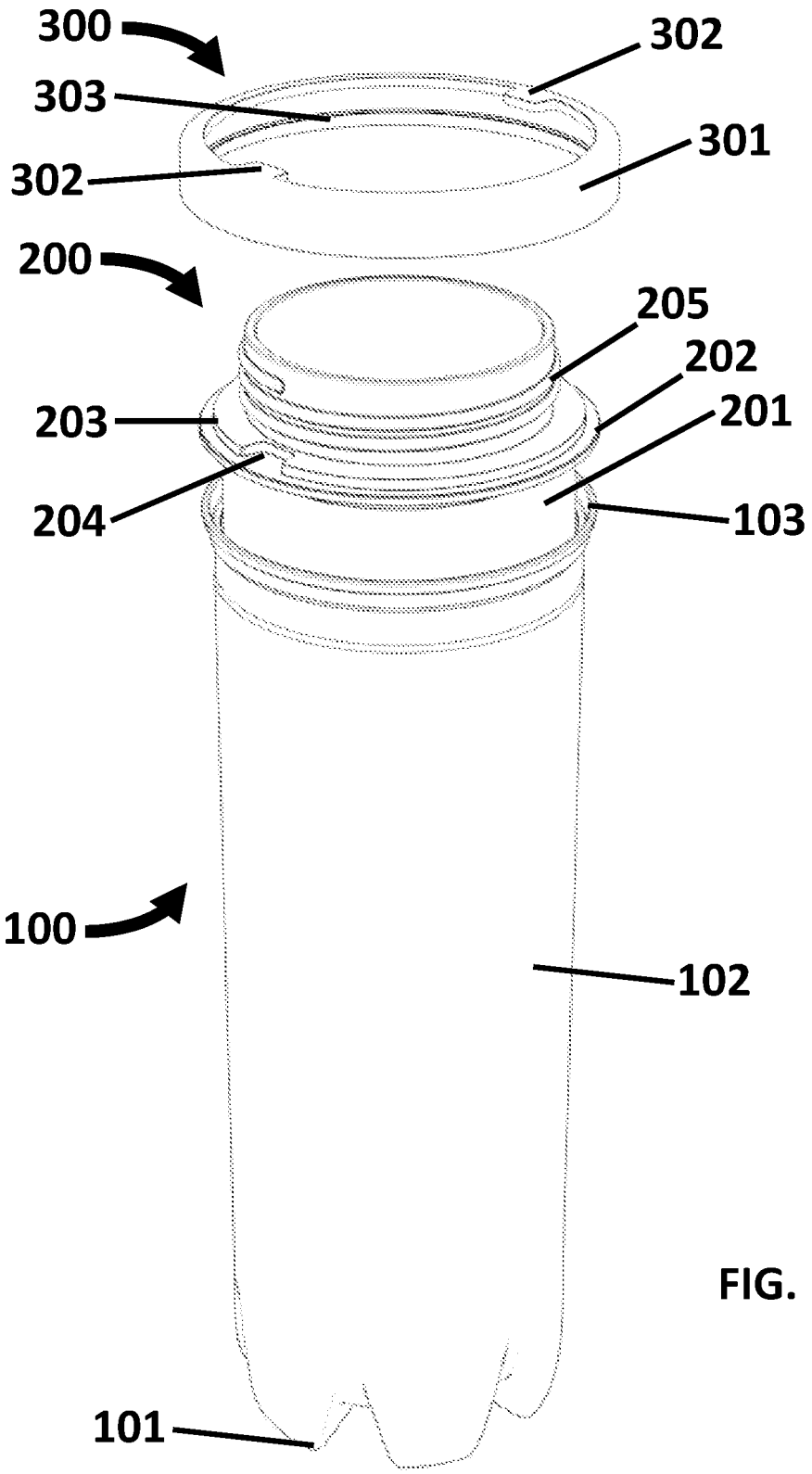
FIG. 1 is an exploded near isometric view of the repurposed tennis ball canister with an insertable liner and a tabbed liner-to-canister retainer ring
Figure 2A:
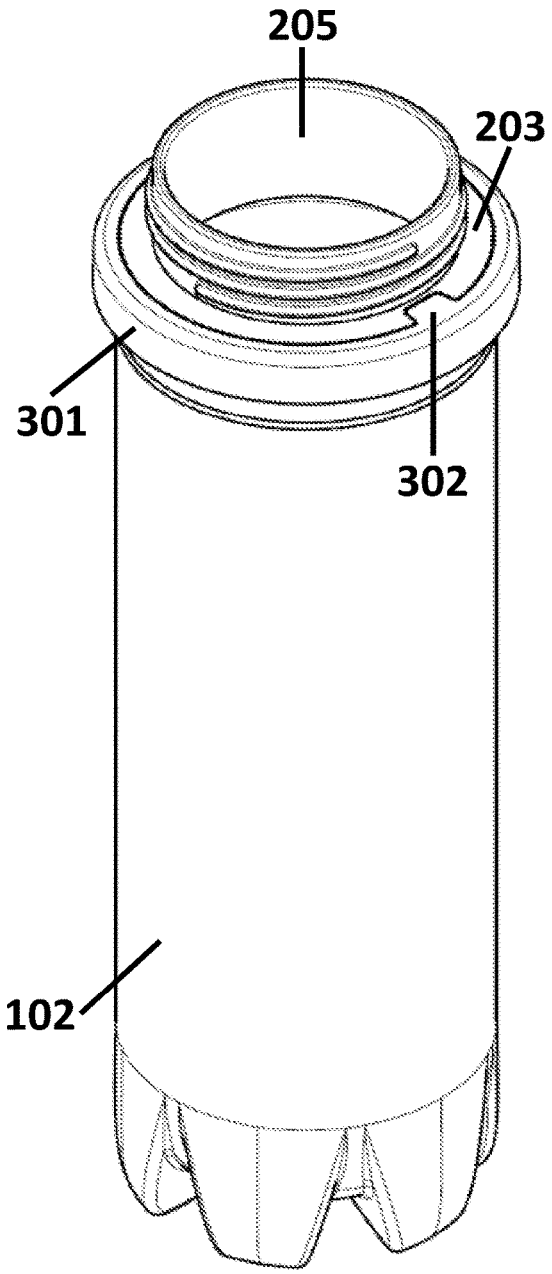
FIG. 2A is an isometric view of the fully assembled repurposed tennis ball canister with an insertable liner and a tabbed liner-to-canister retainer ring with detailed line views defining the geometric facets
Figure 2B:
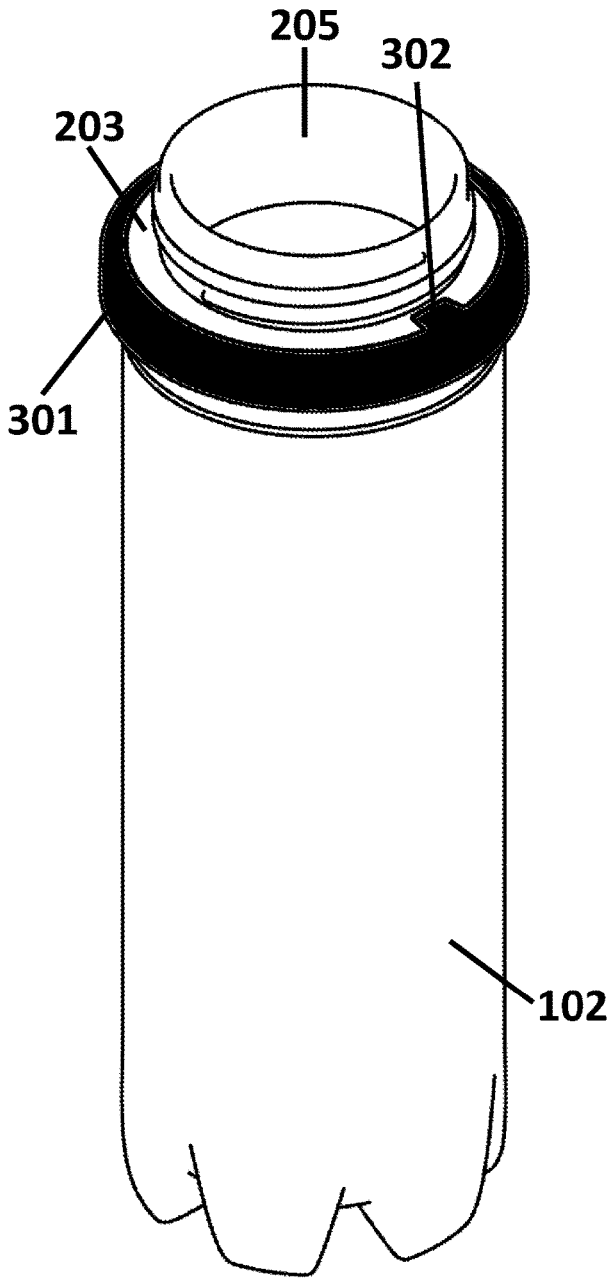
FIG. 2B is an isometric view of the fully assembled repurposed tennis ball canister with an insertable liner and a tabbed liner-to-canister retainer ring, where said retainer ring is shown as solid black to be more clearly delineated from the surrounding parts
Figure 3A:
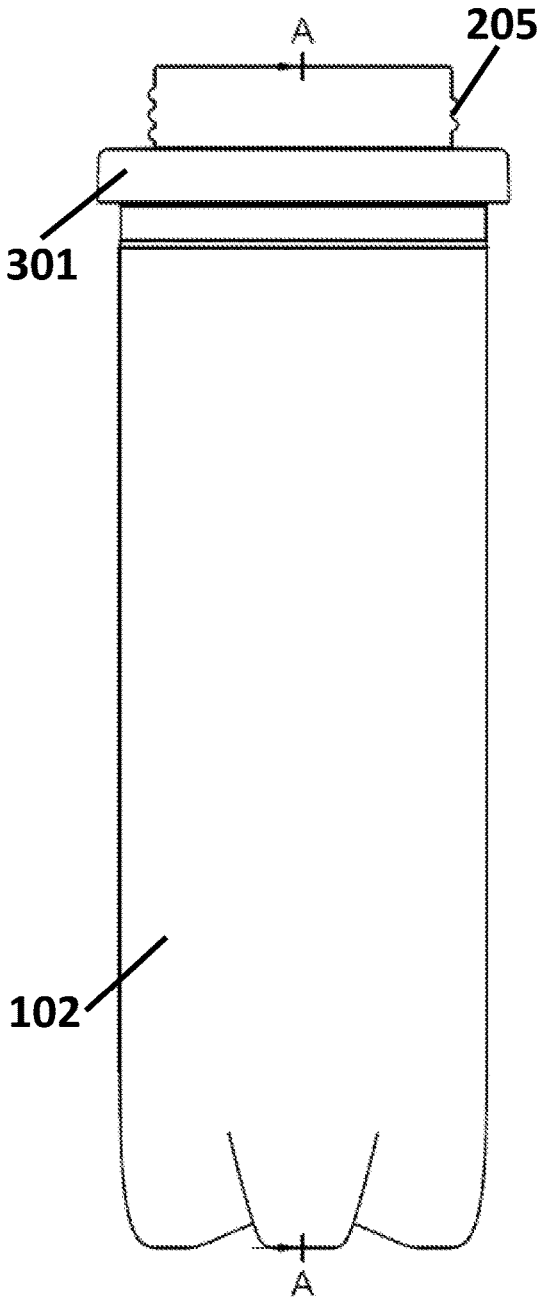
FIG. 3A is a side view of the fully assembled repurposed tennis ball canister with an insertable liner and a tabbed liner-to-canister retainer ring
Figure 3B:
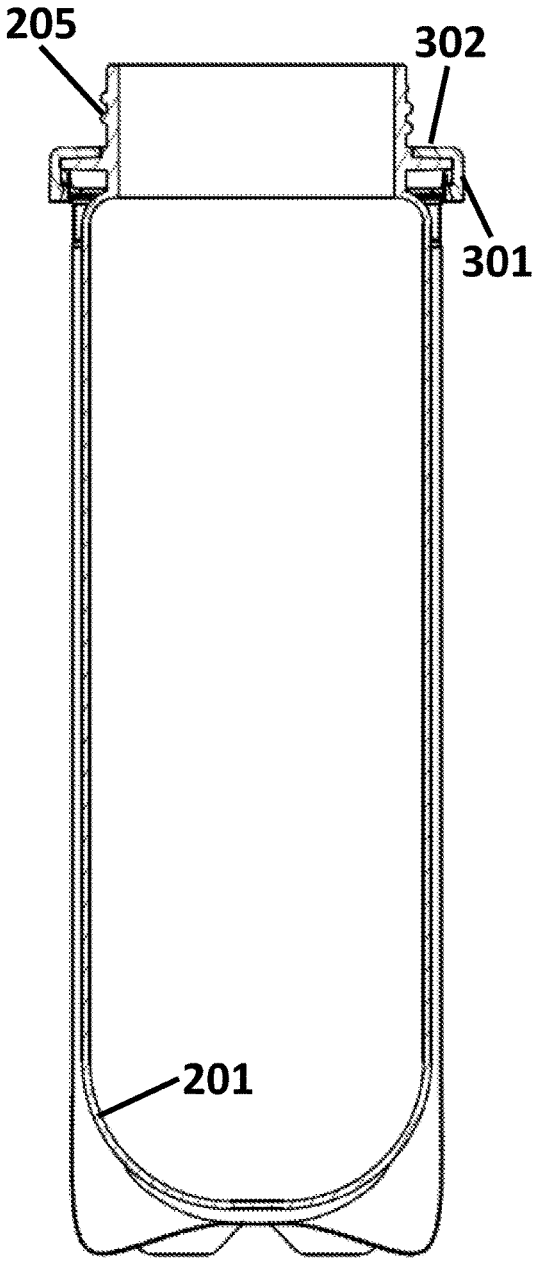
FIG. 3B is a section A-A view of the fully assembled repurposed tennis ball canister with an insertable liner and a tabbed liner-to-canister retainer ring
Figure 4A:
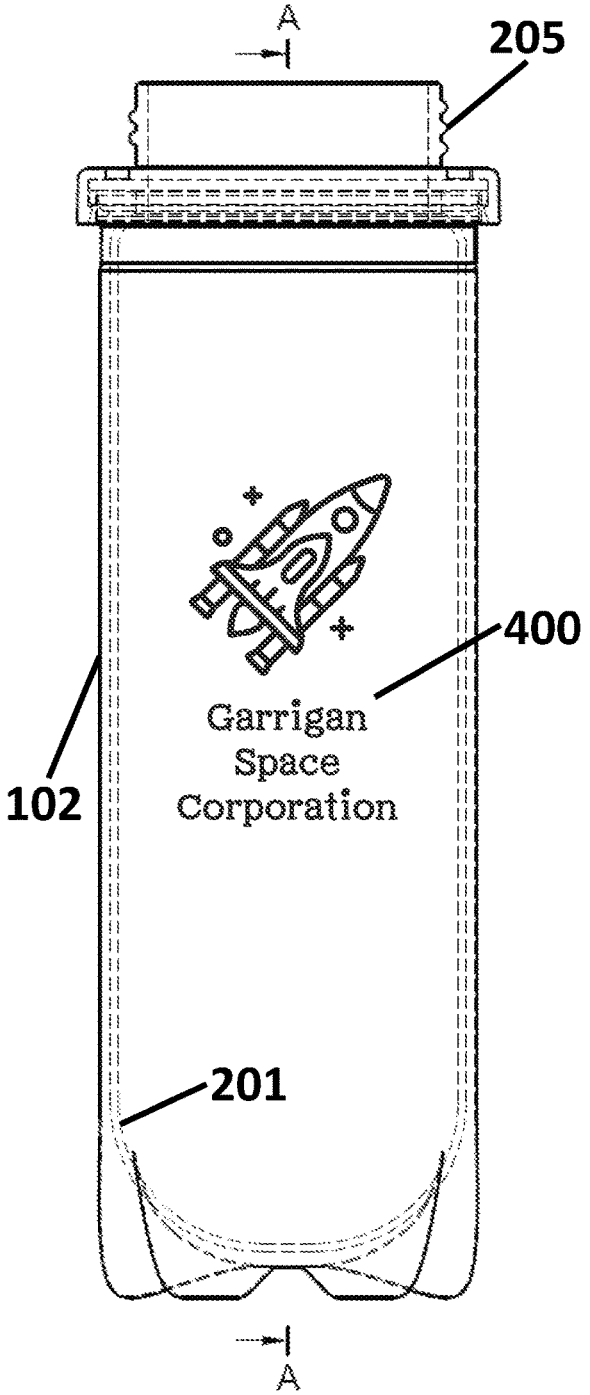
FIG. 4A is a side view with hidden lines of the fully assembled repurposed tennis ball canister with an insertable liner, a tabbed liner-to-canister retainer ring, and an insertable or printed-on design
Figure 4B:
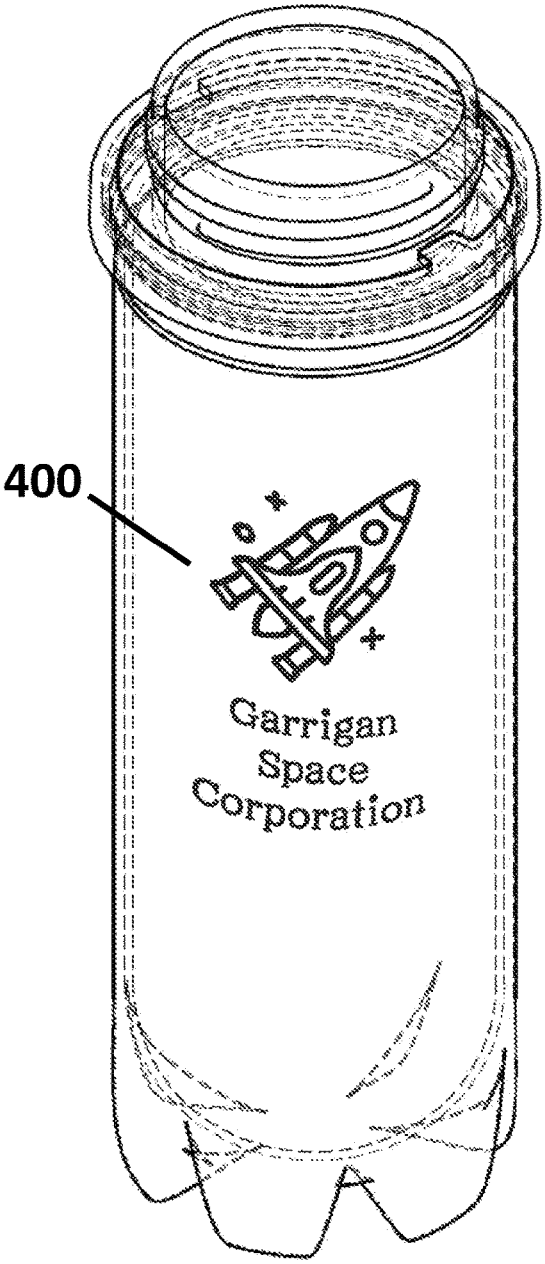
FIG. 4B is an isometric view with hidden lines of the fully assembled repurposed tennis ball canister with an insertable liner, a tabbed liner-to-canister retainer ring, and an insertable or printed-on design

Canister (100): The exemplary embodiment of the canister (100) to which the apparatus aspect of the present invention (200, 300) attaches is cylindrical, although the inventive aspects of the disclosure can be applied to canisters of non-cylindrical form such as cylindrical, hexahedral, etc. For the purposes of explanation, the axial coordinate is the coordinate along or parallel to the centerline axis running along the canister's length. The second coordinate direction is the radial direction, where radially outward is away from the centerline axis of said canister (100). The third coordinate orientation is rotational or angular coordinate, where rotation is about the centerline axis of said canister (100). This coordinate system of the canister (100) is shared with that of the apparatus aspect of the present invention (200, 300) as it is being attached to or already attached to said canister (100).

FIGS. 1-7 show all or portions of a thin-walled canister (100), which comprises a base (101), a barrel (102) section making up most of the canister's axial dimension, and an opening defined by a circle and a ring-like lip (103) attached to the circle, wherein said lip has a small radially outward protrusion that is common with such canisters (100). This particular aspect of the lip (103) allows separate piece(s) with a complementary ridge to engage and be axially constrained in the upward direction or away from the canister's base (101).

Liner (200): FIGS. 1-8 show all or portions of the liner (200). The exemplary case comprises a vessel (201) intended to hold liquid or other substances, a ring-like flange or lower collar flange (202), a ring-like upper collar flange (203) with one or a plurality of notch(es) (204) distributed about the upper collar flange (203), and a collar (205).

In the exemplary embodiment, the liner (200) is made of a hard, generally thin-walled, reusable material with all of the liner's elements (201-205) integrated together from a single mold. For specific applications where one-time use is necessary (e.g., to hold baby formula or medication in a sterile, soft, air-evacuated pouch), an attachable/detachable disposable vessel (201) may be used. Such disposable vessel embodiments may be attached to the lower collar flange (202) by way of pins, clips, threaded fasteners, etc.

If the application is for drinking or holding edible material, then at least the liner's inner surface with which liquid is in contact should be free of harmful or toxic substances including being free of bisphenol A (BPA). Alternative usage embodiments of the present invention can be a storage/dispenser for BB shots, fasteners, chemicals for surgical, manufacturing, or military battlefield applications, etc. In the other embodiments, the liner's material, particularly the inner surfaces are adjusted for chemical compatibility or non-reactive. The liner's material is also dependent on the expected temperature range of usage embodiments. For example, if the application is to hold liquids between the boiling and freezing point, then a chemically safe liner such as PLA based on "Puralact" lactides, polypropylene, or equivalent may be used. Ceramics with food-contact-safe glaze can also be suitable for liner material. In the exemplary and preferred embodiment, the liner is to use Polyhydroxyalkanoates or PHAs, which are polyesters produced in nature by numerous microorganisms and are biodegradable.

The vessel (201) portion is the lowest portion of the liner (200) and when the liner (200) is installed in the canister (100), the vessel occupies a substantial portion of the barrel's (102) inner volume. Hence the radial and axial extents of the vessel (201) are less than the inner radial and axial extents of the barrel (102). The combination of the relative axial length of said vessel (201) and canister's barrel (102) is such that the lower collar flange (202) can be seated on said lip (103).

How much the outer diameter of the vessel (201) is less than that of the barrel's inner diameter (hereinafter stated as "diameter difference") is a key dimensional consideration for various important functions of the present invention (200, 300) when attached to the canister (100). As a baseline, to assure robust fitment in view of manufacturing tolerances, the diameter difference at the typical dimensional scale of a tennis ball canister (100) should be on the order of one or a few millimeters. If an insertable design wrap (400), which will be detailed later, is used, then the diameter difference would be adjusted based on the requisite accommodation of the design wrap (400), which is expected to be minimally more than or the same as the baseline if the wrap is a 20-pound copy paper, but somewhat more if a fabric design wrap is to be used.

Another consideration is the intended criteria for the thermal insulation, or more suitably put, thermal isolation or thermal resistance properties of the liner's vessel (201). Air is a gas and a thicker air gap enabled by a larger diameter difference will augment thermal isolation and insulation. This is because of the well-recognized-in-the-art thermal diffusion property of gas, which is generally poor compared to most solids. Hence a highly thermally isolated embodiment of the vessel (201) will have a diameter difference of at least several instead of a few millimeters. In certain other embodiments, the gap between the vessel (201) and barrel (102) may be filled or wrapped with insulating material like foam, sponge, or neoprene with a porous microstructure and substantial gas or air void fraction. Other gap filler embodiments may be a liquid or gel that can be preheated or cooled within the temperature limits of the canister (100) and the present invention's (200, 300) materials to help maintain the temperature of the substance stored in the vessel (201). Liquid or gel fillers would require the lower surface of the lower collar flange (202) to be coated or layered with a soft material to enhance the seal against the canister's lip (103).

The exemplary vessel (201) houses a single volume. However, alternative embodiments may have a vessel (201) with a plurality of partitions for applications where the substance or liquid in the vessel (201) needs to be segregated. An example application is sport drink mixes where multiple different powders or liquids are initially separated for later mixing.

The lower collar flange (202) is placed on top of the vessel (201) and protrudes radially outward from the radial extent of said collar (205) like a ring on the order of at least a few to several millimeters so that during liner installation, it acts like a stop to prevent further axial displacement into the barrel (102). Adjoining above the lower collar flange (202) is the upper collar flange (203), which in the exemplary embodiment does not extend radially outward from the radial extent of said collar as far as the lower collar flange (202). However, alternative embodiments can allow more equivalent radial extension between the two flanges (202, 203). The important aspect of the upper collar flange (203) is that it has one or a plurality of notch(es) (204) distributed around the circumference of the upper collar flange (203) meant to receive tab(s) (302) from the retainer ring (300), as will be described later.

Adjoining the upper collar flange (203) and extending axial further upward is the liner's collar (205), which in the exemplary embodiment, has a threaded outer surface to receive a lid (500) with a threaded inner radial surface. Alternative embodiments of the collar's outer surface may also be non-threaded and shaped to receive a pop-off lid or even be integrated with a hinged lid or lid with a hinged material pass-through hole(s).

Retainer Ring (300): Elements of the liner's retainer ring (300) are shown in part, section, or entirety in FIGS. 1-8. The retainer ring (300) comprises a band (301) portion that forms a ring, one or more tab(s) (302), and on the inner lower surface of the band (301), a radially inward protruding ridge (303) or more generally a locking topology. While the exemplary retaining ring (300) is circular to fit around the circular lower and upper collar flanges (202, 203), other geometry forms are possible for embodiments where the liner geometry is different.

The top of the exemplary band (301) is radiused inward at one extent into an L-cross section and dimensioned to closely wrap around the upper collar flange (203) during installation. The horizontal or substantially horizontal portion of the band (301), whose under surface is engageable to the top surface of the upper collar flange (203), provides the bulk of the downward application of force on the upper collar flange (203) and thus the liner (200) when the protruding locking topology (303) is snapped under the lip (103). Also in the exemplary retainer ring (300), are a pair of opposing, radially inward extending tabs (302) that are on the order of several millimeters in length and width so that they can be received by the notches (204) of the exemplary upper collar flange (203).

Figure 5A:
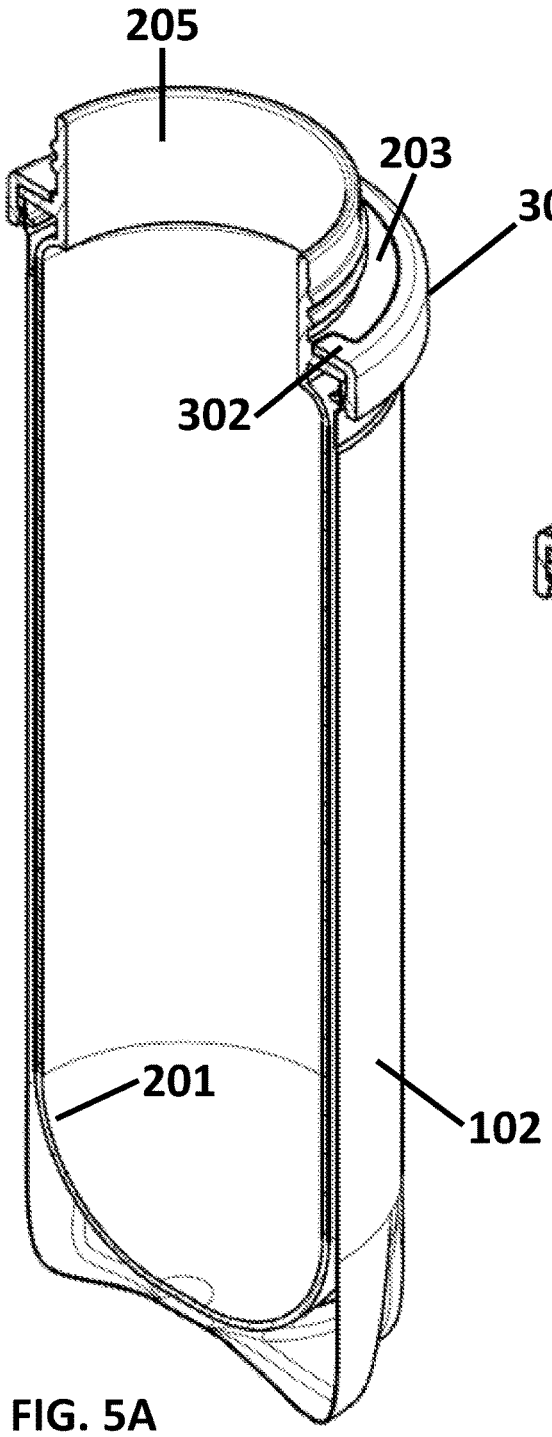
FIG. 5A is an angled section A-A view of the fully assembled repurposed tennis ball canister with an insertable liner and a tabbed liner-to-canister retainer ring
Figure 5B:
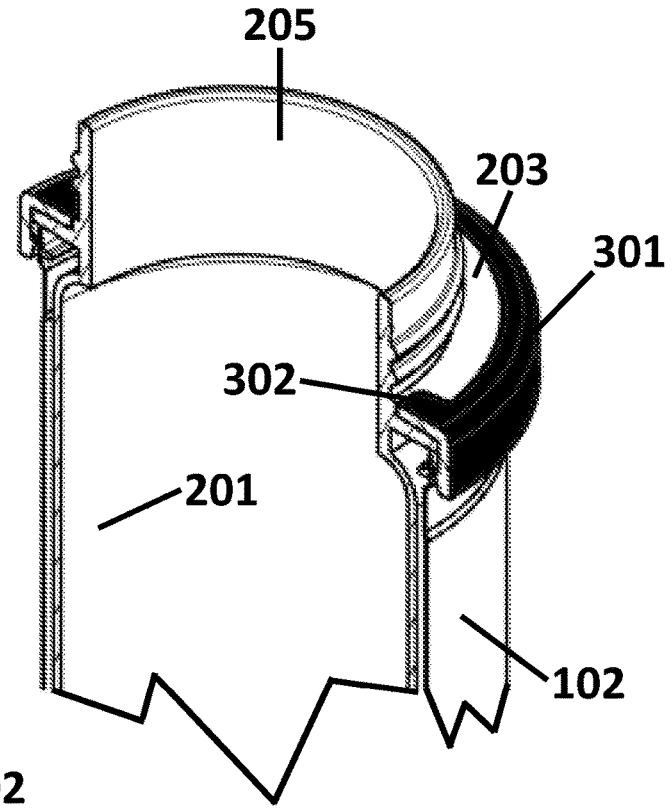
FIG. 5B is a zoomed-in angled section A-A view of the fully assembled repurposed tennis ball canister with an insertable liner and a tabbed liner-to-canister retainer ring with a cutoff break line along the barrel portion of the canister
Figure 6:
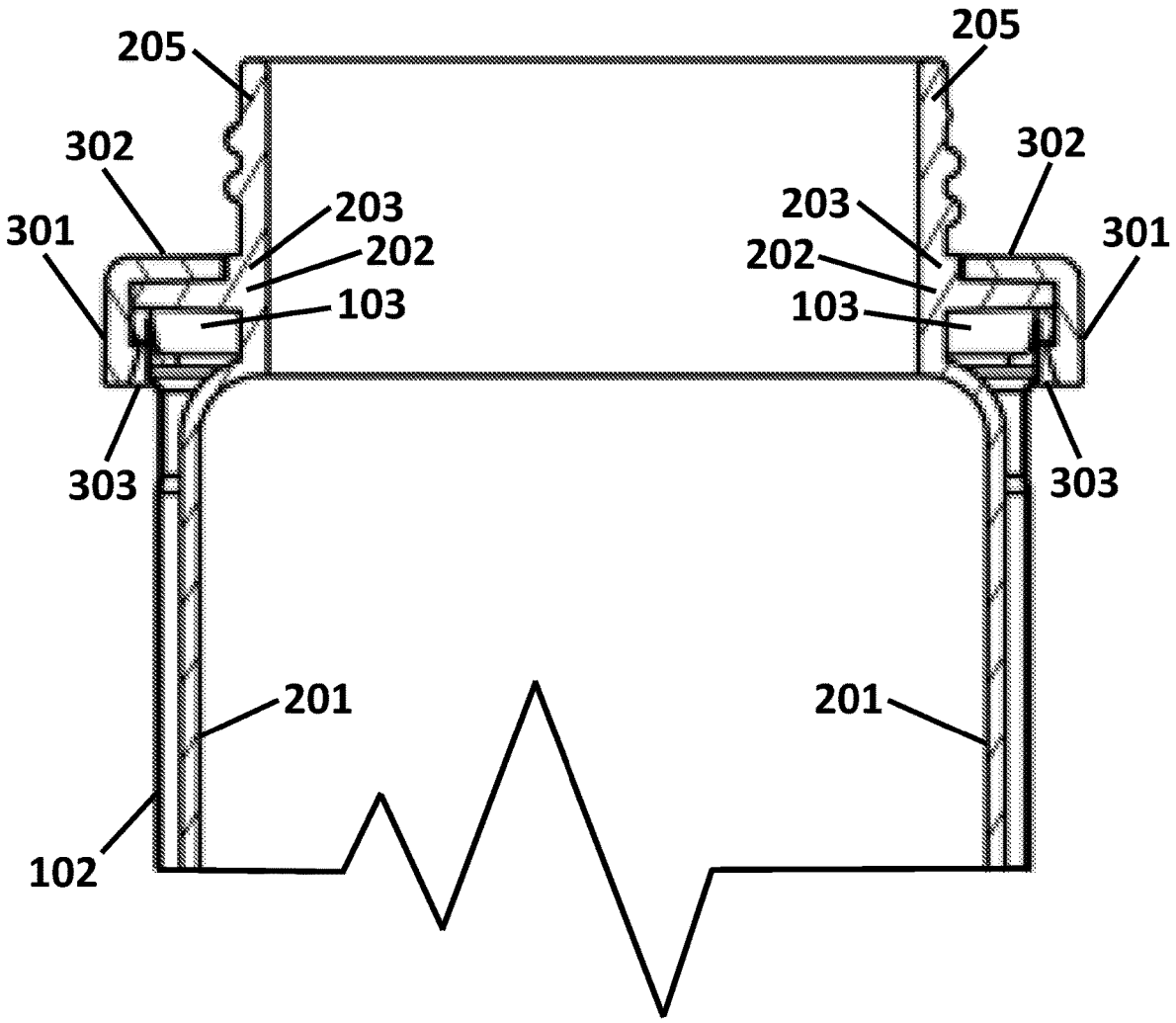
FIG. 6 is a zoomed-in side section A-A view of the fully assembled repurposed tennis ball canister with an insertable liner and a tabbed liner-to-canister retainer ring with a cutoff break line along the barrel portion of the canister
Figure 7A:
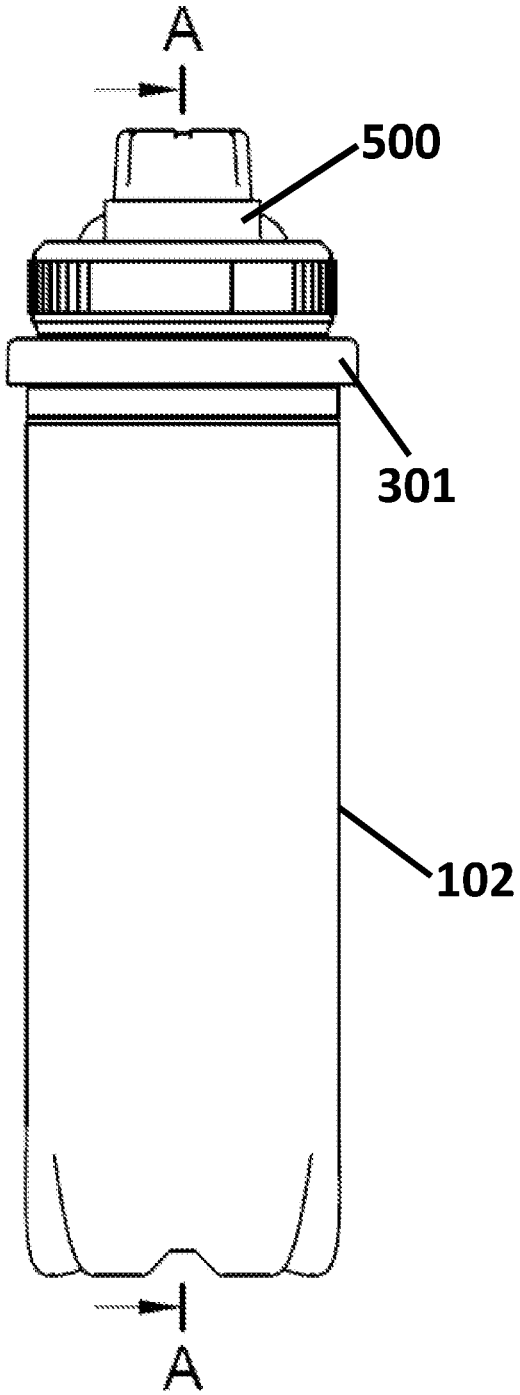
FIG. 7A is a side view of the fully assembled repurposed tennis ball canister with an insertable liner, a tabbed liner-to-canister retainer ring, and a generic screw-on lid
Figure 7B:
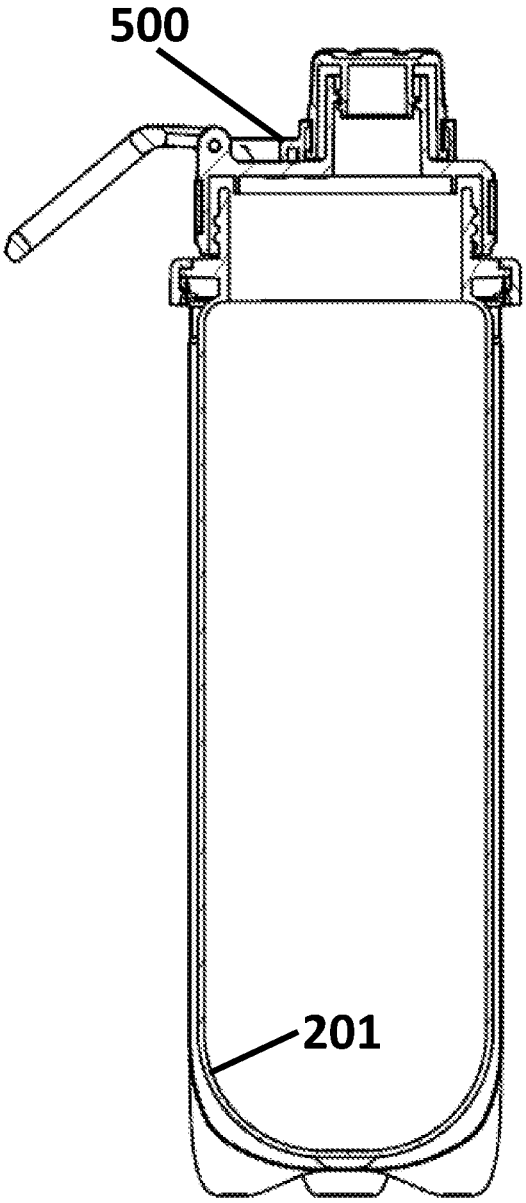
FIG. 7B is a section A-A view of the fully assembled repurposed tennis ball canister with an insertable liner, a tabbed liner-to-canister retainer ring, and a generic screw-on lid
Figure 8:
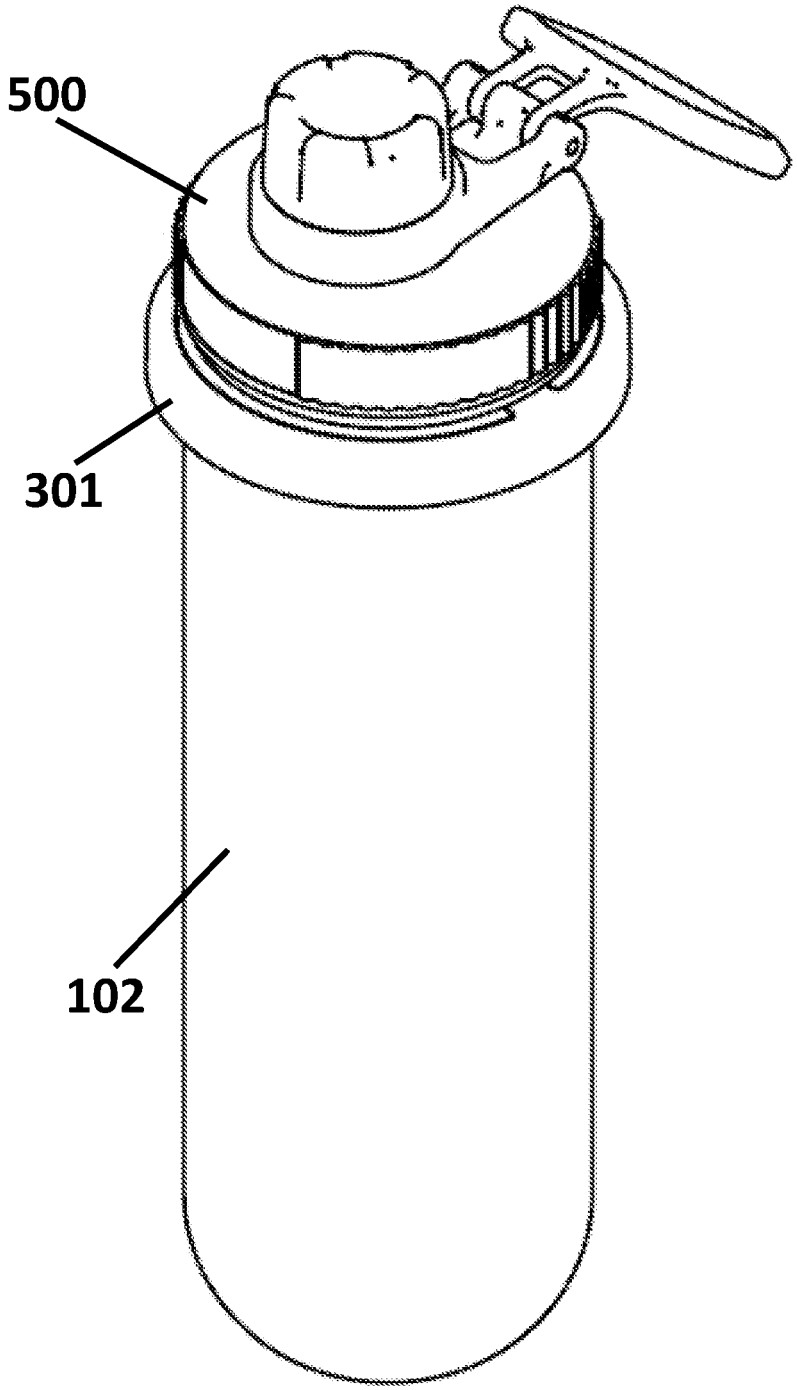
FIG. 8 is an isometric view of the insertable liner, a tabbed liner-to-canister retainer ring, and a generic screw-on lid

As most apparent in FIGS. 5A, 5B, and 6, the liner (200) is axially and rotationally secured to the canister (100) by encircling the lower and upper collar flanges (202, 203) with the retainer ring (300), rotating if necessary the retainer ring (300) so that the tabs (302) are placed within the notches (204), pressing down on the retainer ring so that the locking topology (303) goes around snaps below the lip (103).

The manner of the locking topology (303) engagement to the lip (103) is similar to the way the ridged annulus within a tennis ball canister's original lid "claws" onto the lip (103). As shown in FIG. 1, the ridged annulus embodiment of the locking topology (303), in addition to having a radially inward protruding topology, may also comprise a small upward-turning feature to form a U to better "claw" under the lip (103). Alternative embodiments of said locking topology comprise a c- or u-shaped hook similar to an eagle's talon (not shown) that is periodically distributed along the retainer ring's lower annulus and protruding radially inward.

An additional one or more radially outward protrusions (not shown) from the outer lower surface of the retainer ring (300) can be incorporated into alternative embodiments of the retainer ring (300). This geometric feature allows a user with his/her finger, and in particular, the thumb to pry off the retainer ring (300) and the locking topology (303) above the lip (103) more easily during disassembly.

The retainer ring (300) is preferably constructed from a single molded piece the geometry and material need to support a generally rigid structure with a slight amount of flexibility to allow the retainer ring (300) to deform when the locking topology (303) goes around the lip during removal or installation. Hence, the ring may be made from metal like aluminum or plastic. Suitable plastics can be PHA, acrylic or polymethyl methacrylate, polycarbonate, polyethylene, polypropylene, polyethylene terephthalate, polyvinyl chloride, acrylonitrile-butadiene-styrene, or similar.

Insertable Design Wrap (400): The apparatus aspect of the present invention (200, 300) can be dimensioned by an appropriate diameter difference to accommodate an insertable design wrap (400). The design wrap (400) is meant to allow users to place and, if desired, later update a design to individualize the appearance of the present invention, with an example shown in FIGS. 4A and 4B. A tennis ball canister with a substantially transparent barrel (102) would be required to allow the image of the design wrap (400) to be seen. The wrap's material can comprise a piece of paper, cardboard, cloth, plastic, rubber, metal, wood, foam, sponge, neoprene, and more. Foldable materials like paper can be simply wrapped around the vessel (201) into a tube-like shape prior to assembly.

Embodiments of the design wrap (400) may additionally have high thermal insulation/resistance properties like foam, sponge, or neoprene with a porous microstructure and substantial gas or air void fraction. The design wrap (400) may alternatively be a colorful liquid substance with or without thermal insulating properties. Other alternative embodiments may have the pattern directly printed, etched, or heat embossed on the liner.

Lid (500): The exemplary lid (500) is shaped like a cuff-like cap, where the inner radial surfaces have threads so the lid can be screwed onto the complementary threads on the outer surface of the collar (205). As suggested earlier, the lid (500) can take other forms and be attached in different manners, such as being integrated with the liner or attachable by popping onto the collar (205) of complementary geometry. An integrated lid may be hinged to the collar (205) or be completely molded with the collar (205) and have openable/closable material pass-through holes.

Figure 9:
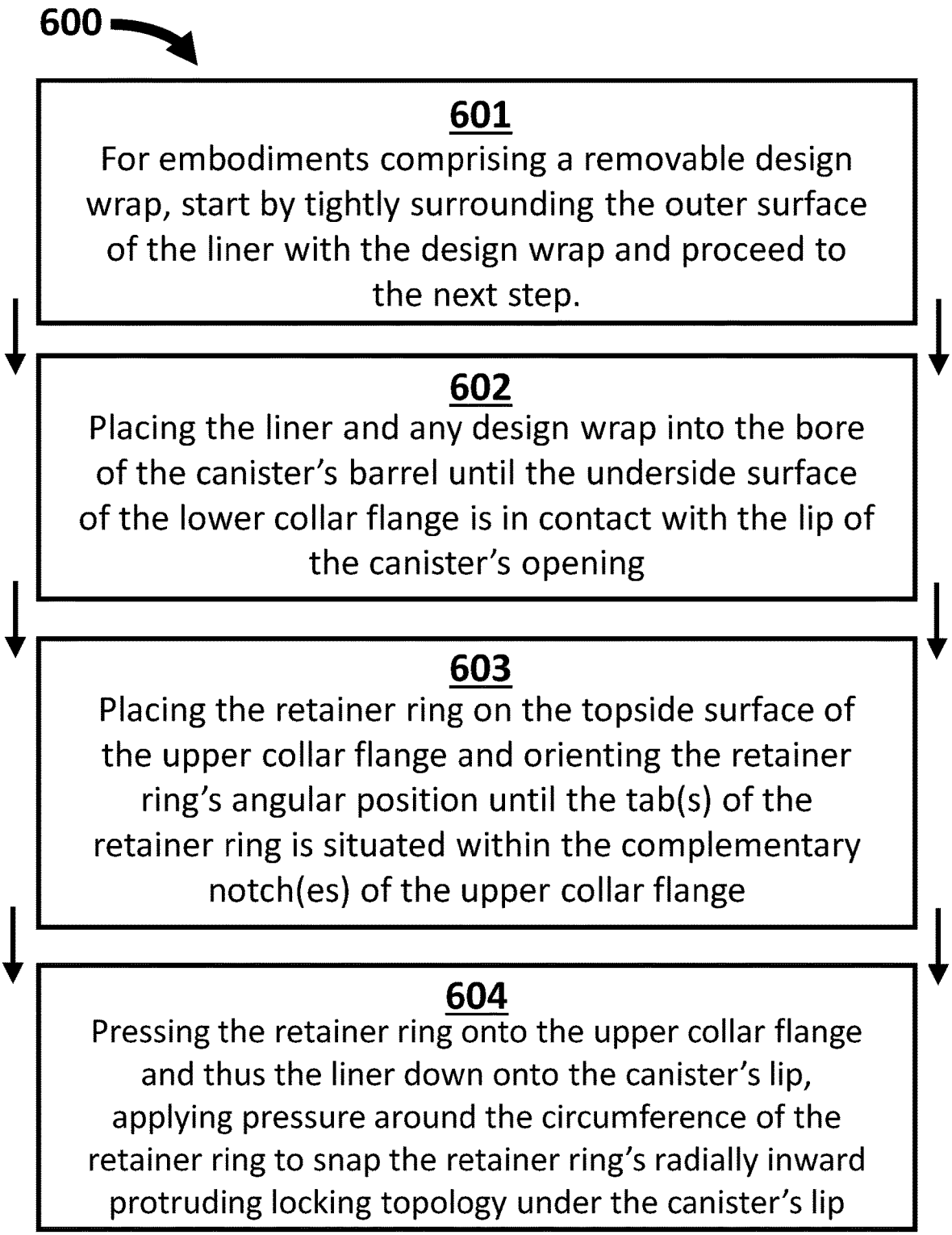
FIG. 9 shows the process of repurposing a tennis ball canister into a beverage container using the insertable liner and tabbed liner-to-canister retainer ring

Method of Repurposing Tennis Ball Canisters (600): With the hardware and apparatus side of the canister (100) and the present invention (200, 300) as previously described on hand, FIG. 9 outlines the procedure to repurpose a tennis ball canister. The first step (601) is for embodiments comprising a removable design wrap (400), where one would start by tightly surrounding the outer surface of the liner (100) with the design wrap (400). After this step (601) is completed or for embodiments that do not involve a design wrap (400), the second step (602) is placing the liner (200) and, if applicable, any design wrap (400) into the bore of the canister barrel (102) until the underside surface of the lower collar flange (202) is in contact with the lip (103) of the canister's opening.

Following this, the third step (603) involves placing the retainer ring (300) on the topside surface of the upper collar flange (203) and orienting the retainer ring's angular position until the tab(s) (302) of the retainer ring (300) is situated within the complementary notch(es) (204) of the upper collar flange (203). The final step (604) is pressing the retainer ring (300) onto the upper collar flange (203) and thus the liner (200) down onto the canister's lip (103), applying pressure around the circumference of the retainer ring (300) to snap the retainer ring's radially inward protruding locking topology (303) under the canister's lip (103).

Many alterations and modifications may be made by those having ordinary skill in the art without departing from the spirit and scope of the embodiment. Therefore, it must be understood that the illustrated embodiment has been set forth only for the purposes of example and that it should not be taken as limiting the embodiment as defined by the following claims. For example, notwithstanding the fact that the elements of a claim are set forth below in a certain combination, it must be expressly understood that the embodiment includes other combinations of fewer, more, or different elements, which are disclosed herein even when not initially claimed in such combinations.

What is claimed is:

1. A system for repurposing tennis ball canisters with a radially protruding lip at its opening, comprising:

a liner;

wherein said liner comprises a vessel that is insertable into said canister, a ring-like lower collar flange that, in combination with a relative axial length of said vessel and a canister barrel portion, can be seated on said lip, adjoining above said lower collar flange, is a ring-like upper collar flange with one or a plurality of notch(es) distributed about said upper collar flange, and adjoining above said upper collar flange, a collar; and a retainer ring.

2. The system as recited in claim 1, wherein at least said vessel's inner surface is chemically compatible, non-reactive, or non-toxic with substance(s) carried inside the vessel for a given application.

3. The system as recited in claim 2, wherein elements of said liner are molded into a single piece.

4. The system as recited in claim 1, wherein said vessel's outer diameter is less than the canister's inner diameter to a degree that can accommodate a design wrap, to increase thermal resistance between the vessel and its contents and the environment outside the canister, and/or to accommodate other substances for decorative and/or thermal enhancing properties.

5. The system as recited in claim 1, wherein said lower and upper collar flanges protrude radially outward from the radial extent of said collar.

6. The system as recited in claim 5, wherein the radial and axial extents of the vessel are less than the inner radial and axial extents of the canister's barrel, such that the combination of the relative axial length of said vessel and canister's barrel is such that the lower collar flange can be seated on said lip.

7. The system as recited in claim 6, wherein the lower surface of the lower collar flange is coated or layered with a soft material to enhance the seal against the canister's lip.

8. The system as recited in claim 1, wherein said retainer ring comprises a band portion that forms a ring, one or more tab(s) that are placed and dimensioned to be insertable within said notch(es), and on the inner lower surface of the band, a radially inward protruding locking topology that is engageable with said lip.

9. The system as recited in claim 8, wherein said band is radiused inward at one extent into an L-cross section and dimensioned to closely wrap around the upper collar flange during installation of said liner and retainer ring to said canister.

10. The system as recited in claim 8, wherein said locking topology is a ridged annulus.

11. The system as recited in claim 10, wherein said ridged annulus further comprises an upward-turning ridge to form a U.

12. The system as recited in claim 8, wherein said locking topology comprises a c- or u-shaped hook that is periodically distributed along the retainer ring's lower annulus.

13. The system as recited in claim 8, wherein said retainer ring comprises one or more radially outward protrusions from the outer lower surface of said retainer ring.

* * * * *